United States Patent [19]

Greis

[11] 4,322,961

[45] Apr. 6, 1982

[54] DIE ROLLING MACHINE

[75] Inventor: Howard A. Greis, Holden, Mass.

[73] Assignee: Kinefac Corp., Worcester, Mass.

[21] Appl. No.: 124,916

[22] Filed: Feb. 26, 1980

[51] Int. Cl.[3] ..... B21B 31/24

[52] U.S. Cl. ..... 72/95; 72/104; 72/108

[58] Field of Search ..... 72/95, 98, 108, 109, 72/111, 104

[56] References Cited

U.S. PATENT DOCUMENTS

| | | | |
|---|---|---|---|
| 181,010 | 8/1876 | Prosser | 72/95 |
| 430,359 | 6/1890 | White | 72/104 |
| 637,320 | 11/1899 | Billings | 72/104 |
| 1,141,427 | 6/1915 | Simpkins | 72/95 |
| 2,294,685 | 9/1942 | Nelson | 72/104 |
| 2,771,799 | 11/1956 | Batchelder | 72/104 |
| 3,269,161 | 8/1966 | Greis | 72/98 |

*Primary Examiner*—Lowell A. Larson
*Attorney, Agent, or Firm*—Charles R. Fay

[57] ABSTRACT

A machine for the rolling of cylindrical forms such as threads, worms, serrations, and annular forms, using two cylindrical dies whose axes are parallel or slightly skewed with respect to the axis of rotation of the workpiece, wherein the dies are supported on pivoting arms whose pivot points are cooperatively adjustable about a fixed horizontal centerline to provide for work diameter and die size changes. Workpiece size adjustment is achieved by a micrometer drawbar which can be either fixed for thru-feed work or hydraulically or mechanically actuated for infeed work. The dies are cooperatively driven by a central gearbox consisting of a hollow distributor gear flanked by two spindle drive gears, said drive gears being connected to the ends of the die spindles by universal joints.

26 Claims, 9 Drawing Figures

DIE ROLLING MACHINE

PRIOR ART

The closest prior art applicant is aware of his own U.S. Pat. No. 3,269,161 which is directed to a die roll forming and finishing machine having a pair of swinging arms which mount the dies between them in generally a similar relationship as that disclosed herein, but the arms indicated at 16 and 18 in FIGS. 1 and 4 of the patent are mounted on a single pivot as at 14. This results in a machine which is very efficient for high speed production of relatively small pieces. This machine has been very successful in practice but when larger, heavier pieces are to be made, the arms 16 and 18 have to be designed stronger and heavier and the weight of the machine becomes considerable; whereas the present machine in which the die roll supporting arms are mounted on individual pivot means can be made of lighter weight while still rolling the larger, heavier objects.

BACKGROUND OF THE INVENTION

In the field of cylindrical die roll forming of threads, worms, splines, and similar forms on shafts, to achieve high production it is necessary to have automatic feed units and special fixturing to place the work piece in the rolling area, hold it there during the rolling operation, and eject it upon the completion of the rolling operation. To accomplish these functions at high speed with simple mechanisms and to make them economical to build, easy to set up, operate and maintain, it is desirable to have a rolling machine with a horizontally-fixed rolling centerline. Otherwise, each time a part is rolled the feeding system must accommodate the side shifting of the part horizontally into the dies, and then it must shift the formed part horizontally out of the dies before it can axially transport the part.

In addition, when manually rolling large parts, the conventional two-die rolling machines, in which only one die moves, also must accommodate the side-shift of the rolling axis of the work during penetration. To prevent incorrect location of the initial rolling track requires complex work-holding fixtures which must permit horizontal side-shifting of the axis of rotation while at the same time preventing the rolling axis from going out of parallel with respect to the center lines of the dies.

Finally, if only one die on a two-die rolling machine moves, then the work-support blade must be horizontally adjustable.

To elimate these problems economically in medium and large size rolling machines, while at the same time obtaining other significant advantages, this invention employs a unique, self-centering, double pivot rolling die support system which, combined with a unique gear box arrangement, achieves low production cost, simple economical operation, and great mechanical rigidity.

SUMMARY OF THE INVENTION

The cylindrical die rolling machine of the present invention consists of a pedestal on which is mounted a base plate which has location slots machined into it for the various elements of the machine. This base plate mounts two adjustable pivot blocks which can be cooperatively moved about the horizontal centerline of the machine by a set of right and left hand pivot adjustment screws whose end point is axially fixed to the base plate.

Mounted on each adjustable pivot block is a long, horizontal hingelike pivot whose axis is substantially parallel to the axis of rotation of the dies and the rolling centerline. Directly connected to each of these pivots is a rigid, "L" shaped, arm system carrying a spindle unit mounted such that the pivot point is approximately below the axis of die rotation.

The dies are driven cooperatively by a gearbox mounted on the rear of the pedestal. This gearbox consists of a hollow distributor gear whose axis is substantially concentric with the fixed rolling centerline. The distributor gear drives two spindle drive gears mounted in the gearbox on either side of it which are in turn connected to the spindles by a double universal joint system which includes a sliding splined joint in between the two universal joints. The distributor gear is smaller than the two spindle drive gears, providing some speed reduction and torque increase, and is located so that long thru-feed work can pass through the hole in its center. Mounted on an extension of the distributor gear outside of the gearbox is a large diameter sheave which is driven by a belt from a much smaller sheave mounted directly on an electric drive motor. This produces further speed reduction and torque increase. The two arms are drawn together by a large diameter prestressed drawbar assembly which has a micrometer size adjustment nut on one end. In thru-feed applications where it is only necessary to hold the arm in a fixed, rigid position, the other end of the drawbar terminates in a large nut. For infeed applications, the drawbar is actuated by a hydraulic cylinder or a mechanically-driven rotary cam device. In either case, the connection between the drawbar and each of the arms is through a hemispherical joint to permit angular motion under load.

The arms, and thus the rolling centerline, are held fixed during die actuation by a linkage system. This system consists of a centralizing link connecting each of the arms to a sliding block which in turn moves vertically in a close-fitting slot located directly under the rolling centerline in the pedestal.

During the rolling operation the workpiece is supported on a blade such that the centerline is slightly below the line between the centerline or the two dies. The blade is mounted on a rolling support device, the height of which is externally adjustable. The vertical adjustment is achieved by rotating a micrometer dial which in turn moves a longitudinal cam to provide upward movement of the support table.

In the infeed mode of operation, a blank is placed upon the blade and the dies are actuated inwardly under hydraulic pressure while the dies are rotating. They contact the work and deform it while simultaneously rotating it. They continue to penetrate inwards progressively deepening the deformation until they reach the end of their stroke. At that time the dies continue to rotate the piece for several more work revolutions in order to round it up. Upon completion of that dwell portion of the cycle the hydraulic actuation is terminated and the dies return to their original position. The operator then removes the completed piece from its position at rest on the top of the work support blade.

PREFERRED EMBODIMENT OF THE INVENTION

Figure 1:
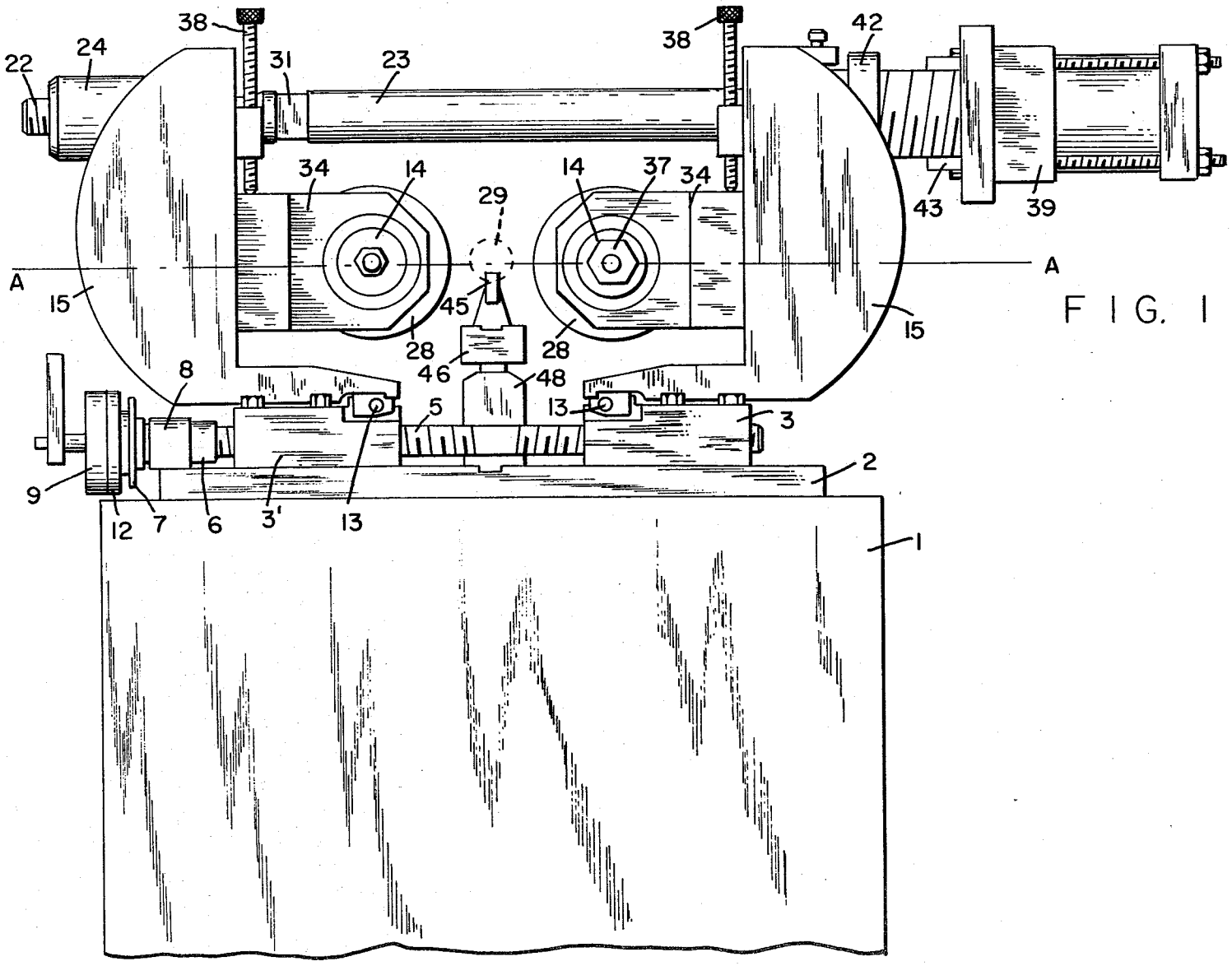
FIG. 1 is a front view showing the machine as a whole.

The machine of the present invention is provided with a heavy welded pedestal 1 upon which is mounted a heavy steel baseplate 2. As shown in FIG. 1, the two pivot blocks 3 and 3' are mounted in an adjustable manner on the baseplate 2. They are maintained in their correct axial position by the rear pivot adjusting nuts 4 and 4' which fit into holes in the pivot blocks 3, and each has a key section which extends out the bottom of and below the respective pivot block and fits into a slot which extends transversely across the rear of the baseplate 2. The front pivot adjusting nuts 4' do not have a key and are, therefore, free to move both transversely and axially on the baseplate.

Figure 6:
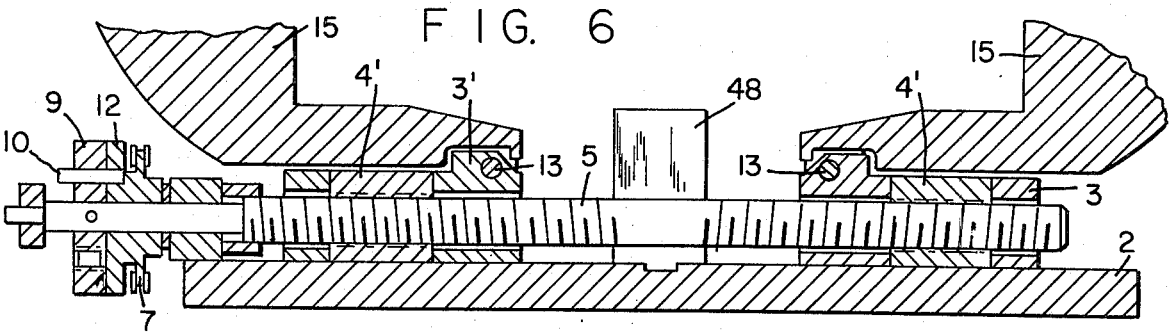
FIG. 6 is a sectional view on line 6—6 of FIG. 2 showing the pivot adjusting mechanism.

As can be seen from FIG. 6, the pivot adjusting screws 5—5' engaged with nuts 4 and 4' have right and left-hand threads on either end respectively and are restrained from transverse movement by collars 6, sprocket 7 and pivot position dial 9 which straddle a mounting plate 8 which is rigidly fixed to the base 1. Therefore, when the pivot adjusting screws 5 are rotated, the pivot adjusting nuts 4 and 4' move symmetrically inward or outward with respect to the machine centerline.

Figure 4:
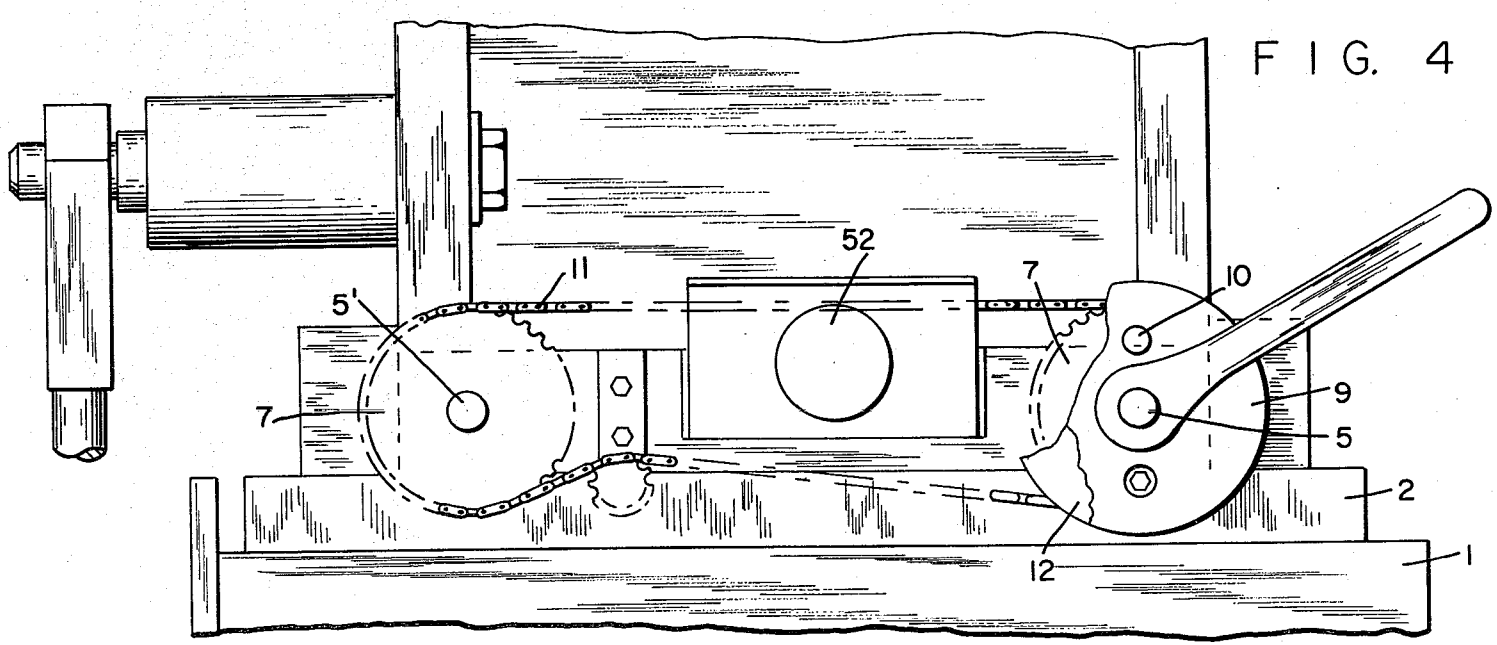
FIG. 4 is a side view of the machine showing the pivot position and taper adjustment, looking in the direction of arrow 4 in FIG. 2.

As can be seen from FIG. 4, the sprocket 7 is rotationally fixed to the rear pivot adjusting screw 5', while the sprocket to the right is free to rotate with respect to the front pivot adjusting screw 5.

Returning to FIG. 6, the pivot position dial 9 is rigidly fixed to the front pivot adjusting screw 5. A removable pin 10 connects the front sprocket 7 to the pivot position dial 9 such that when the ratchet wrench 13 rotates the front pivot adjusting screw 5, the rear pivot adjusting screw 5' is driven rotationally in phase with it by the chain 11 so that the pivot blocks 3 and 3' move toward or away from the rolling centerline while remaining parallel to each other.

When it is necessary to taper the location of the spindle centerlines with respect to one another, the pin 10 is removed and the taper adjustment dial 21 and pivot adjustment dial 9 are rotated with respect to one another and then locked in that relative position.

Figure 2:
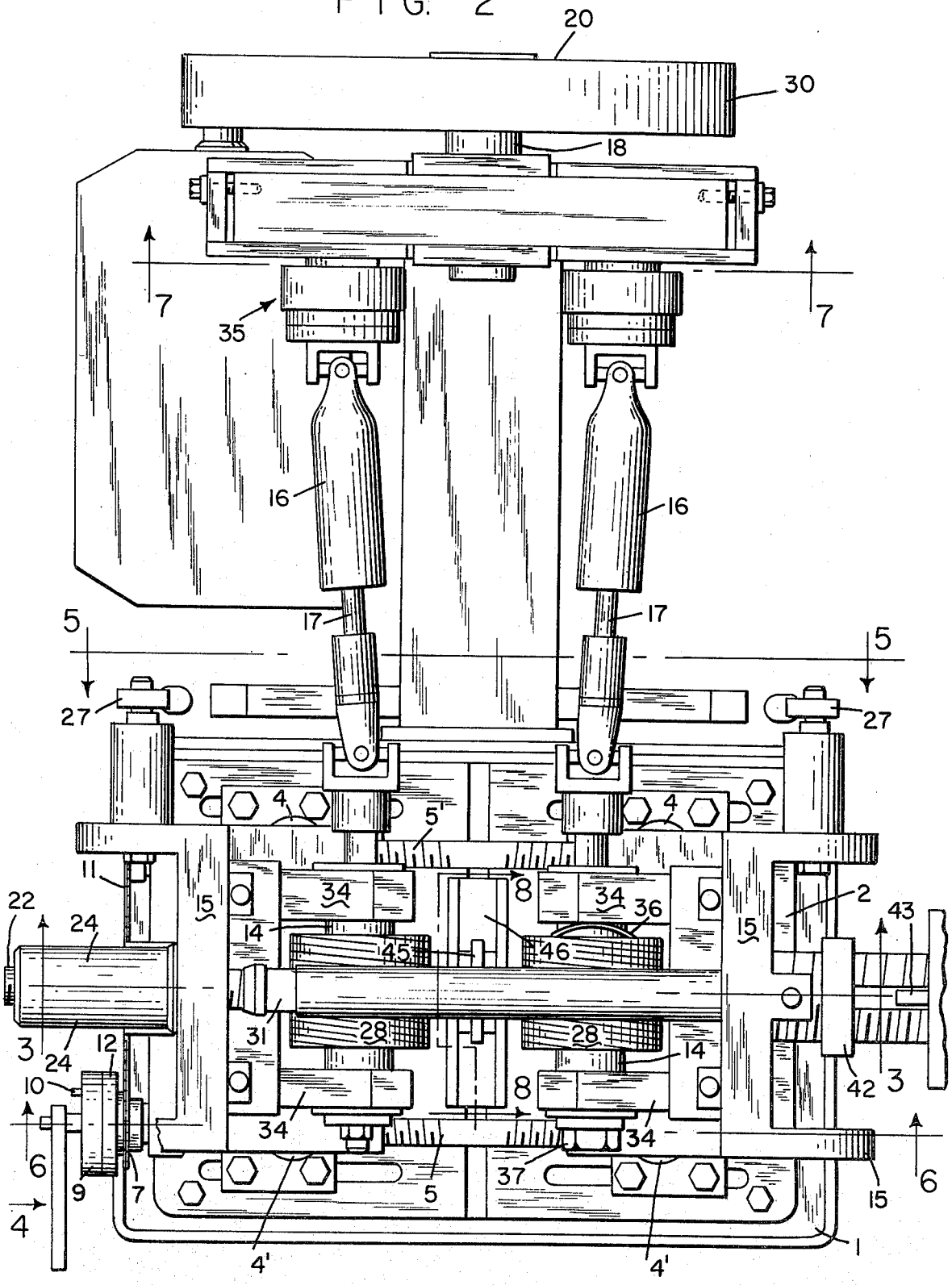
FIG. 2 is a top view showing the machine as a whole with the covers removed.
Figure 3:
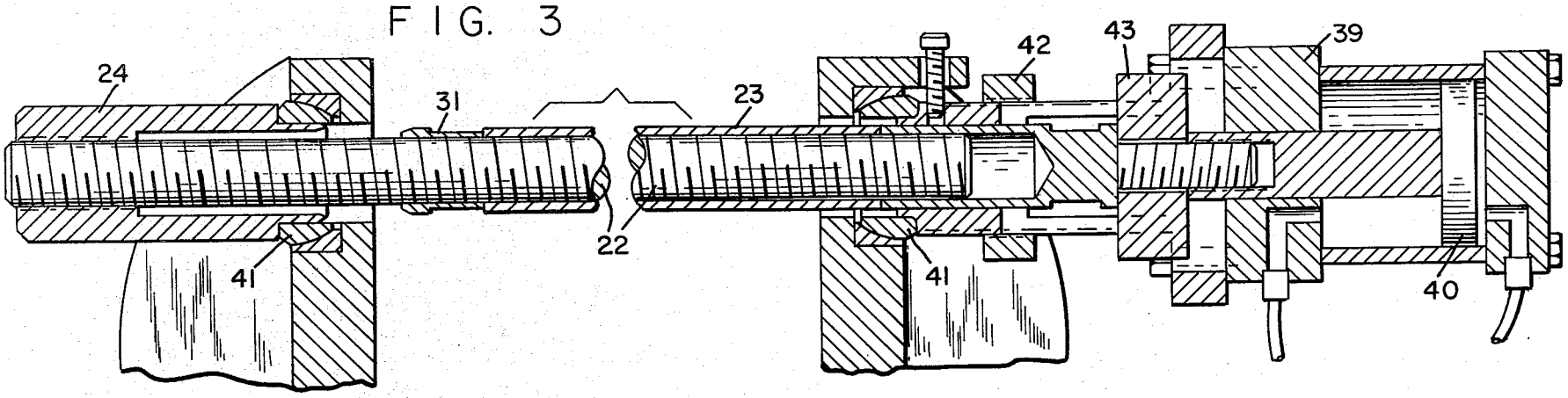
FIG. 3 is a sectional view through the draw bar assembly taken on line 3—3 in FIG. 2.

Arms 15 are arranged facing each other and are connected to pivot blocks 3 by pivot shafts 13, see FIGS. 1 and 6. Spindles 14 are supported from the arms 15 by a set of pillow blocks 34 mounted in a rotatable manner so they can be skewed about the axis A up to an angle of approximately 15°. The dies 28 are mounted on the spindles 14 and are driven in phased rotation to one another. This is achieved by connecting the rear end of the spindles 14 through double universal joints 16 which have a splined joint 17 in their center, (FIG. 2). In the rear of the machine these universal joints are connected to two spindle drive gears 19 which are driven from a central distributor gear 18. On the rear extension of the central distributor gear 18 is a large driven sheave 20, in turn driven from a driver sheave 21 mounted on an electrical motor, hydrostatic drive or similar prime mover, driven through belt 30. In some cases where precise angle phasing of the two dies is required, a rotary matching device 35 is inserted between the output of one of the spindle drive gears 19 and the respective double universal joint 16. In addition, it is possible to axially match one die with respect to the other through the use of an axial matching spring 36 mounted behind the right die 28, FIG. 2, which is compressed or relaxed to provide correct position by rotating the axial matching nut 37 which is mounted on a stud extending from the front of the spindle 14. The skew of the spindles is adjusted through the use of two skew adjusting screws 38 which force the pillow blocks 34 into the correct angular position.

In operation the two dies 28 are drawn together toward the work piece location 29, FIG. 1, by an actuated draw bar assembly consisting of a threaded draw bar 22 which is connected to a hydraulic cylinder 39 by a connecting sleeve 32. The draw bar is prestressed to minimize deflection under load by a prestressing sleeve 23 which is put into compression by prestressing nut 31. The final penetration position of the dies 28 when the piston 40 in the hydraulic cylinder 39 bottoms-out is adjusted through the use of a micrometer size adjustment nut 24 which mounts on the draw bar 22. It is calibrated to indicate changes in final die position to the nearest 0.001". To carry the thrust load while at the same time allowing for angular displacement, ball joints 41 are located between the draw bar assembly thrust areas and the arms. The die opening stroke is adjustable by moving the opening adjustment stop nut 42 to the desired position such that the open stroke stop block 43 comes to rest in the desired position.

Figure 5:
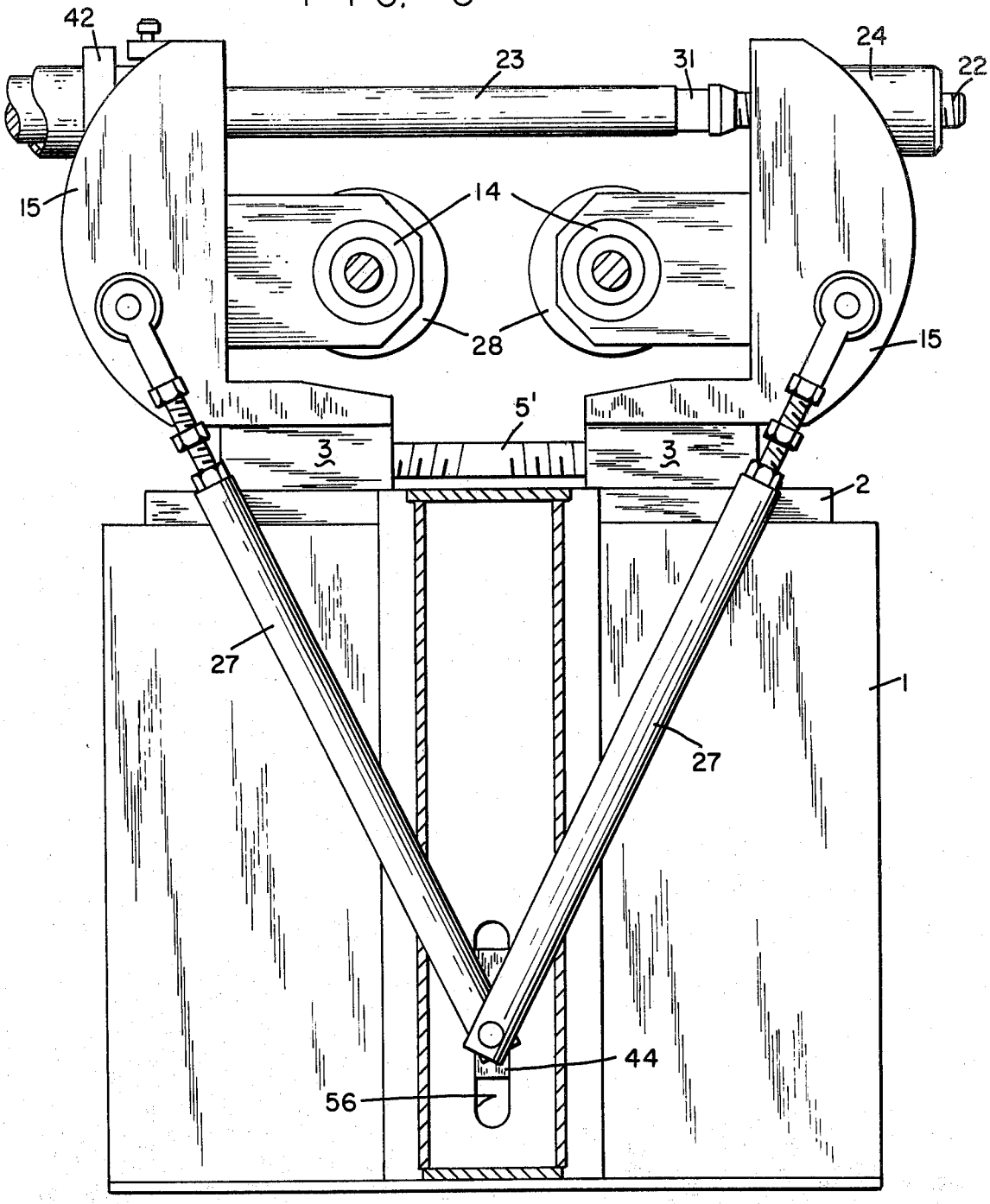
FIG. 5 is a section on line 5—5 of FIG. 2 showing a rear view of the front of the machine and the arm centralizing linkage system.
Figure 7:
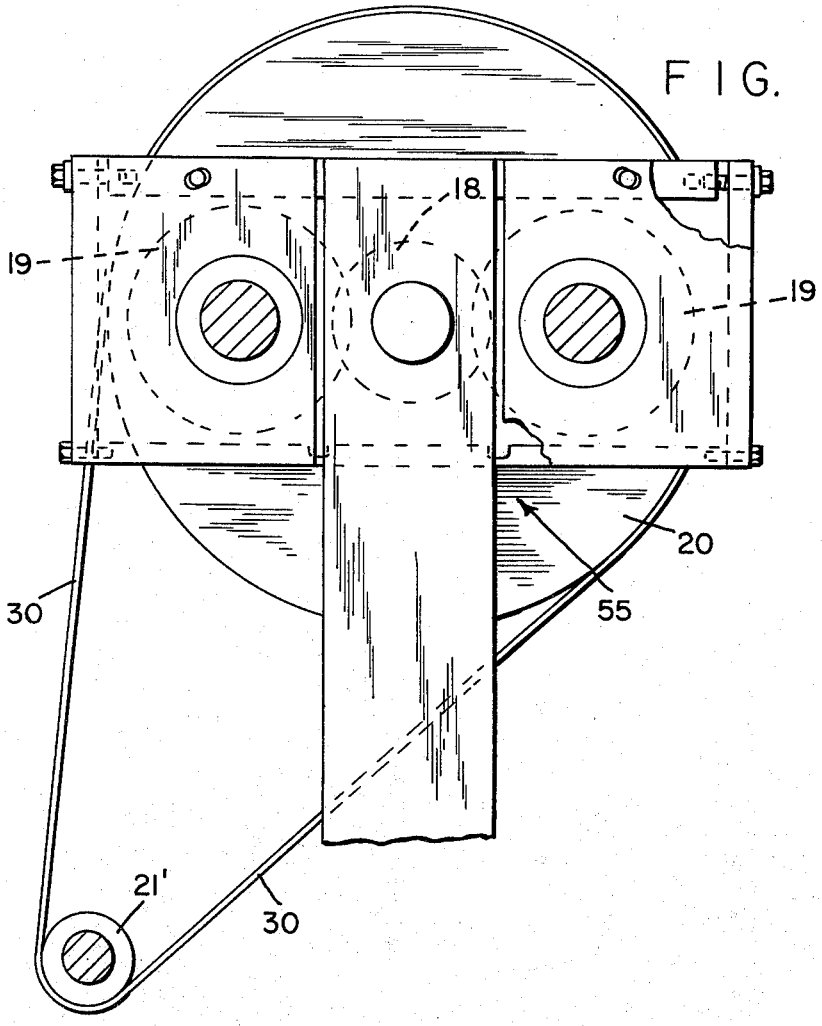
FIG. 7 is a section on line 7—7 of FIG. 2 showing the front of the gearbox and sheave system and showing the gear meshes and sheave arrangement.
Figure 8:
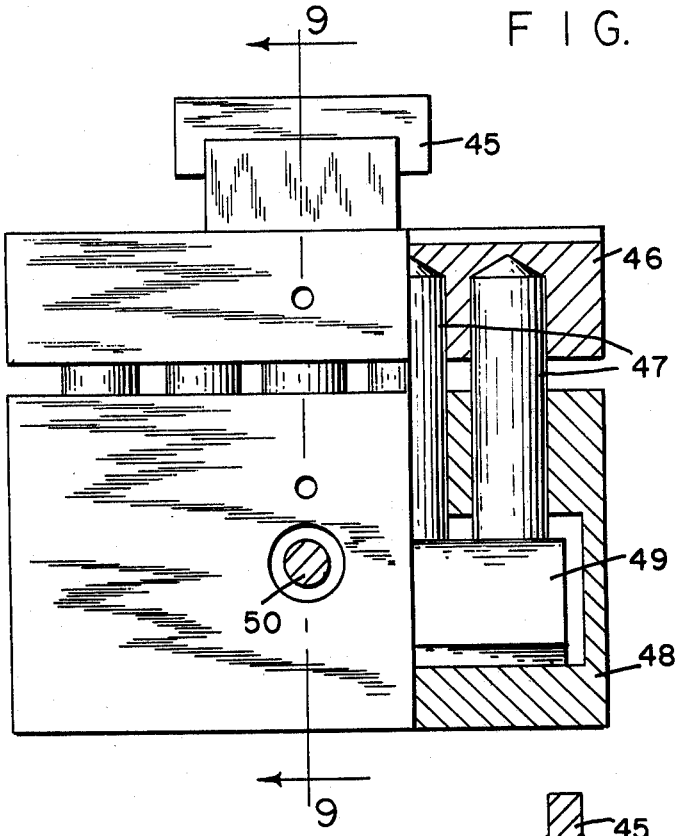
FIG. 8 is a side view of the externally-adjustable rolling support unit with a partial section to show parts of the height adjustment device.
Figure 9:
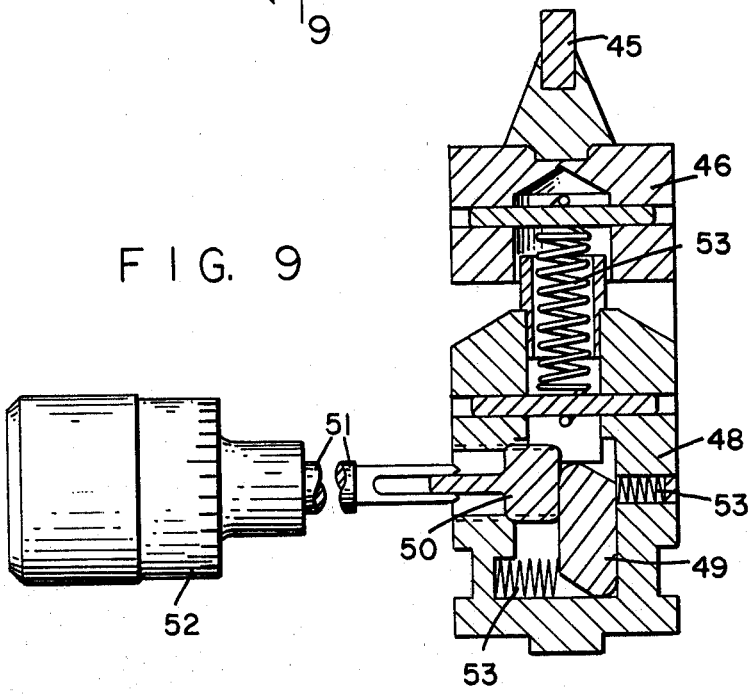
FIG. 9 is a sectional view of the externally-adjustable rolling support unit showing the adjustment and return spring mechanisms and taken on line 9—9 of FIG. 8.

To insure that both dies move toward or away from the work piece location at the same rate, the arms 15 are connected to a slider block 44 through two adjustable-length centralizing links 27, FIG. 5. The slider block 44 moves vertically in a plane which passes through the centerline of the machine in a close-fitting slot 56. During initial machine calibration the centralizing links 27 are adjusted so that the centerlines of the spindles are always equi-distant from that plane. As a result, the rolling centerline is always substantially on the center of the work support blade 45 and concentric with the hole through the hollow distributor gear 18. The work support blade 45 is mounted on a rolling support assembly, shown in FIGS. 8 and 9. The unit consists of a rolling support table 46 mounted on four posts 47 which slide vertically in close fitting holes of the support base 48. They contact cam plate 49 which is a guadrilateral element having rounded corners joining two opposite flat sides included relative to intervening flat parallel sides, and which pivots about its rounded lower right corner as in FIG. 9. The cam plate 49 is actuated by an actuation screw 50 which is in turn rotated through a shaft 51 which extends to the outside of the machine. On its outboard end, within easy reach of the operator, is a work support adjustment dial 52 which is calibrated approximately in 0.001" increments. The return springs 53 apply pressure to each of the key elements to always maintain the blade support table stably downward thereby eliminating backlash in the adjustment system. The gear box shown in FIG. 7 can be adjusted to remove backlash which results from either manufacturing or subsequent wear. By loosening the bolts which hold the faces together and rotating the backlash adjustment screw 54 by adjusting them inward, the right and left hand sections of the gearbox flex inward about the reduced section in the bottom frame bar 55. The whole machine is normally surrounded by splash guards and covers to maximize operator's safety and contain the oil which is normally sprayed onto the dies and work piece during the rolling cycle.

I claim:

1. A die rolling machine comprising two cylindrical dies for rotating and forming a workpiece on an axis between the dies, means to rotate the dies, means for moving the dies toward each other, a separate die supporting arm for each die, said die supporting arms being pivotable on separate spaced pivot axes, means to pivot said die supporting arms, the pivot axes for the die supporting arms being substantially parallel with the axis of workpiece rotation and below the latter axis, the means for moving the dies being above said axis.

2. The die rolling machine of claim 1 wherein the separate pivot axes of the die supporting arms are taperable with respect to the axis of workpiece rotation.

3. The die rolling machine of claim 1 including means to adjust the die rolling arms to a mutual relatively inclined relation.

4. The die rolling machine of claim 1 wherein the pivot axes of the die supporting arms are located approximately in planes that pass through the respective die centerlines perpendicular to the axis between the centerlines.

5. The die rolling machine of claim 1 including means for symmetrically adjusting the pivot axes of the die supporting arms about the plane passing through the work rotation axis and perpendicular to a line between the centers of the dies.

6. The die rolling machine of claim 1 including means to cause the arms to pivot at the same rate toward or away from the plane passing through the work rotation axis and approximately perpendicular to a line between the centerline of the dies.

7. The die rolling machine of claim 6 wherein the lastnamed means includes a linkage connected to the die supporting arms to cause the arms to pivot at the same rate toward or away from the plane passing through the work rotation axis and approximately perpendicular to a line between the centerline of the dies.

8. The die rolling machine of claim 5 including spaced front and rear pivot adjustment means operatively associated with the die supporting arms to adjust the arms relatively to each other.

9. The die rolling machine of claim 1 wherein the means for moving the dies toward each other includes a drawbar connecting the two die supporting arms, said drawbar selectively being fixed or being actuated by power means to extend or retract.

10. The die rolling machine of claim 9 wherein the drawbar is prestressed to minimize deflection during the rolling operation.

11. The die rolling machine of claim 1 wherein the means to rotate the dies includes a gearbox, said gearbox having a hole through a central distributor gear thereof providing passage therethrough for the thru-feed rolling of long workpieces to the dies.

12. The die rolling machine of claim 1 including a rolling work support device, and means to adjust the same externally thereof.

13. The die rolling machine of claim 11 wherein the gearbox includes spindle drive gears, and means to adjust the gears for backlash with respect to the central distributor gear by the deflection of the frame of the gearbox.

14. The die rolling machine of claim 1 wherein the means for pivoting the die supporting arms comprises a link connected to each arm at points spaced from the pivot axes of the arms, said links being connected together at a point at their opposite ends and spaced from the work rotation axis, and means to constrain the connection motion to a plane passing through the work centerline perpendicular to a plane passing through the pivots.

15. The die rolling machine of claim 14 including means to adjust the die supporting arms to an angular relation.

16. A die rolling machine comprising a base, two die supporting arms on the base in spaced generally parallel relation thereon, means supporting a rotary die on each arm, said dies being cooperatively positioned to rotate and form a workpiece therebetween, pivot means on the base for each die supporting arm, said pivot means being spaced and generally parallel, and means to uniformly control the pivot action of the die supporting arms on their pivot means toward and away from each other, the said control means being located at one side of the pivot means for the die supporting arms, and a drawbar pivoted to the die supporting arms at the opposite side of the pivot means and of the dies, to draw the die supporting arms and dies toward each other.

17. The die rolling machine of claim 16 including means to adjust the die supporting arms symmetrically to positions out of parallelism relative to the workpiece centerline.

18. The die rolling machine of claim 17 including power means to rotate the dies, said power means including a central gearbox, the gearbox being generally coaxial with a workpiece between the dies, and an opening through the gearbox coaxial with the workpiece in operating position, said opening admitting a long workpiece therethrough to the dies.

19. The die rolling machine of claim 18 wherein the means to uniformly pivot the die supporting arms comprises a link pivotally arranged with respect to the arms and constrained perpendicularly with respect to the base.

20. A die rolling machine comprising two cylindrical dies, a separate die supporting arm supporting each die, the die supporting arms being pivotable on separate axes, means for pivoting the die supporting arms, the workpiece having an axis of rotation between the two cylindrical dies, the workpiece axis and the pivot axes of the die supporting arms being substantially parallel, adjusting means for moving each of the pivot axes laterally of a plane extending through the workpiece axis perpendicular to the plane of the pivot axes, said adjusting means being effective to move said pivoting axes equally and simultaneously toward and away from said plane, and means to move the die supporting arms and their dies toward each other, said die arm supporting means being at the side of the dies opposite the pivot axes of the die supporting arms.

21. The die rolling machine of claim 20 wherein said adjusting means is effective to taper said pivoting axes symmetrically relative to said plane.

22. The die rolling machine of claim 21 wherein said adjusting means comprises:

(a) a block for pivotally supporting each of the supporting arms, and (b) a screw threadingly engaged with said block and extending laterally of said plane.

23. The die rolling machine of claim 22 wherein each supporting arm is threadingly engaged with the portions of the screw that engage the block of one supporting arm being of opposite hand from the portions of the screw that engage the block of the other supporting arm.

24. The die rolling machine of claim 23 wherein there are two spaced parallel screws and means are provided for selectively turning both screws simultaneously to maintain said pivoting axes parallel or selectively turning one of the screws independently of the other to symmetrically taper said pivoting axes relative to said plane.

25. The die rolling machine of claim 20 including guide means for causing said supporting arms to pivot simultaneously and equally.

26. The die rolling machine of claim 25 wherein said guide means comprises:

(a) slide block mounted for sliding movement along an axis that is intermediate said pivoting axes and bisests said workpiece axis, (b) a connecting arm for each supporting arm, one end of each connecting arm being pivotally connected to the supporting arm and the other end of the connecting arm being pivotally connected to the slide block.

* * * * *